US006089244A

United States Patent [19]

Ko

[11] Patent Number: 6,089,244

[45] Date of Patent: Jul. 18, 2000

[54] WINDPROOF UMBRELLA STRUCTURE

[76] Inventor: Chin-Sung Ko, No. 27-1, Lane 188, Sec. 3, Chin Mar Road, Changhua, Taiwan

[21] Appl. No.: 09/249,818

[22] Filed: Feb. 16, 1999

[51] Int. Cl.[7] ..... A45B 25/22

[52] U.S. Cl. ..... 135/33.7; 135/32; 135/33.41; 135/29

[58] Field of Search ..... 135/33.7, 33.2, 135/31, 32, 33.41, 33.6, 29

[56] References Cited

U.S. PATENT DOCUMENTS

| | | | |
|---|---|---|---|
| 858,967 | 7/1907 | Dimond | 135/33.2 |
| 1,088,743 | 3/1914 | Swinland | 135/33.7 |
| 5,115,827 | 5/1992 | Lee | 135/33.7 |
| 5,487,401 | 1/1996 | Johnson et al. | 135/33.7 |
| 5,601,103 | 2/1997 | Dubinsky | 135/33.7 |
| 6,024,109 | 2/2000 | Lin et al. | 135/33.7 |

*Primary Examiner*—Carl D. Friedman
*Assistant Examiner*—Winnie Yip
*Attorney, Agent, or Firm*—Rosenberg, Klien & Lee

[57] ABSTRACT

A windproof umbrella structure includes mainly a connector being provided at a pivoted position of the main rib and the stretcher to engage with a second rib. The invented assembled frame is covered by an upper cover and a lower cover and obtains a better umbrella strength. When the upward wind occurs, the airflow can pass through the gap between the two covers for avoiding the damage of the ribs.

1 Claim, 6 Drawing Sheets

WINDPROOF UMBRELLA STRUCTURE

BACKGROUND OF THE INVENTION

In order to prevent from damage of the umbrella when it occurs upward wind, there are some designs with double covers on the frame of the umbrella, which can release pressure for avoiding the ribs of the frame being unusually folded and broken. As shown in FIG. 1, it can be seen that a prior known windproof umbrella includes a main rib (1) extending outsides from the upper notch (11) and being covered with an upper cover (12). A second rib (13) is pivoted on the main ribs (1) at a middle bottom position, while a lower cover (14) is covered on the second rib (13). A stretcher (15) has the outer end to pivot with the second rib (13). When the upward wind occurs, the main rib (1) and the second rib (13) are capable of changing the related position by the wind pressure and the airflow can pass through between the two covers (12), (14). The drawback of this umbrella is that the main rib (1) only extends to the board of the upper cover (12). The lower cover (14) is supported by the second only. The strength of the umbrella is thus not enough that the second rib (13) might be easily broken by the wind pressure.

As shown in FIG. 2, it shows another windproof umbrella with a single main rib (2) to increase the strength of the umbrella. The lower cover (21) covers the area from the pivoted position of the main rib (2) and a stretcher (22) to an end (23) of the main rib (2). The upper cover (24) covers a notch (25) and the middle place of the frame of the umbrella and has a plurality of connectors (26) on the board to connect a related end (23) of the main rib (2) with a wire (27). It is to be understood that a gap exists between the two covers for releasing the pressure of the upward wind. The drawback of the design is that the upper cover (25) is connected with the end (23) of the main rib (2) by the wires (27) only and the strength of the umbrella is still not enough for avoiding damage.

OBJECT OF THE INVENTION

The main object of the present invention is to provide an improved windproof umbrella structure with novel assembly of the umbrella cover and the ribs of the frame, which obtains a better strength and improvement.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
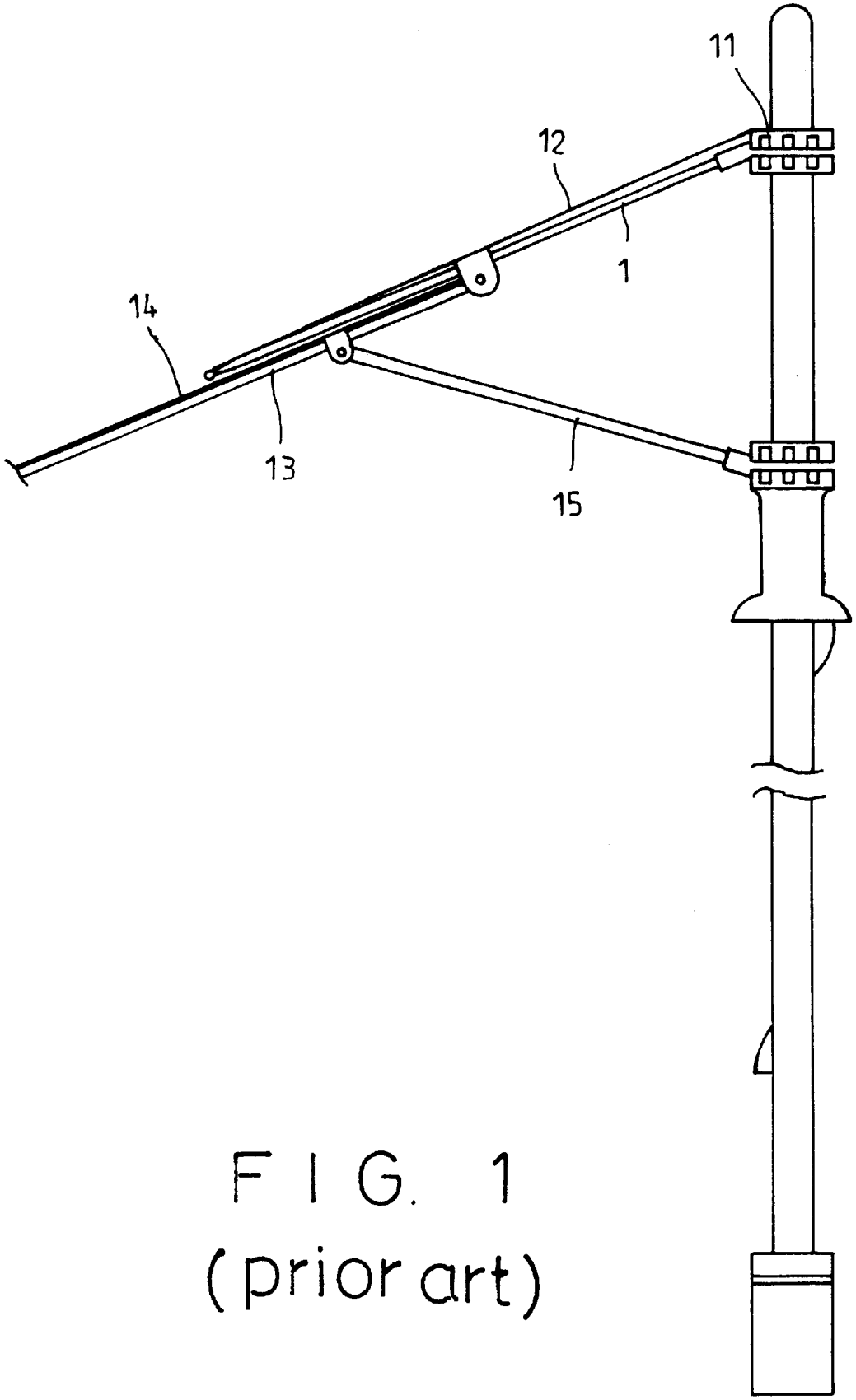
FIG. 1 (prior art)
FIG. 1 is a plan view of a prior known windproof umbrella.
Figure 2:
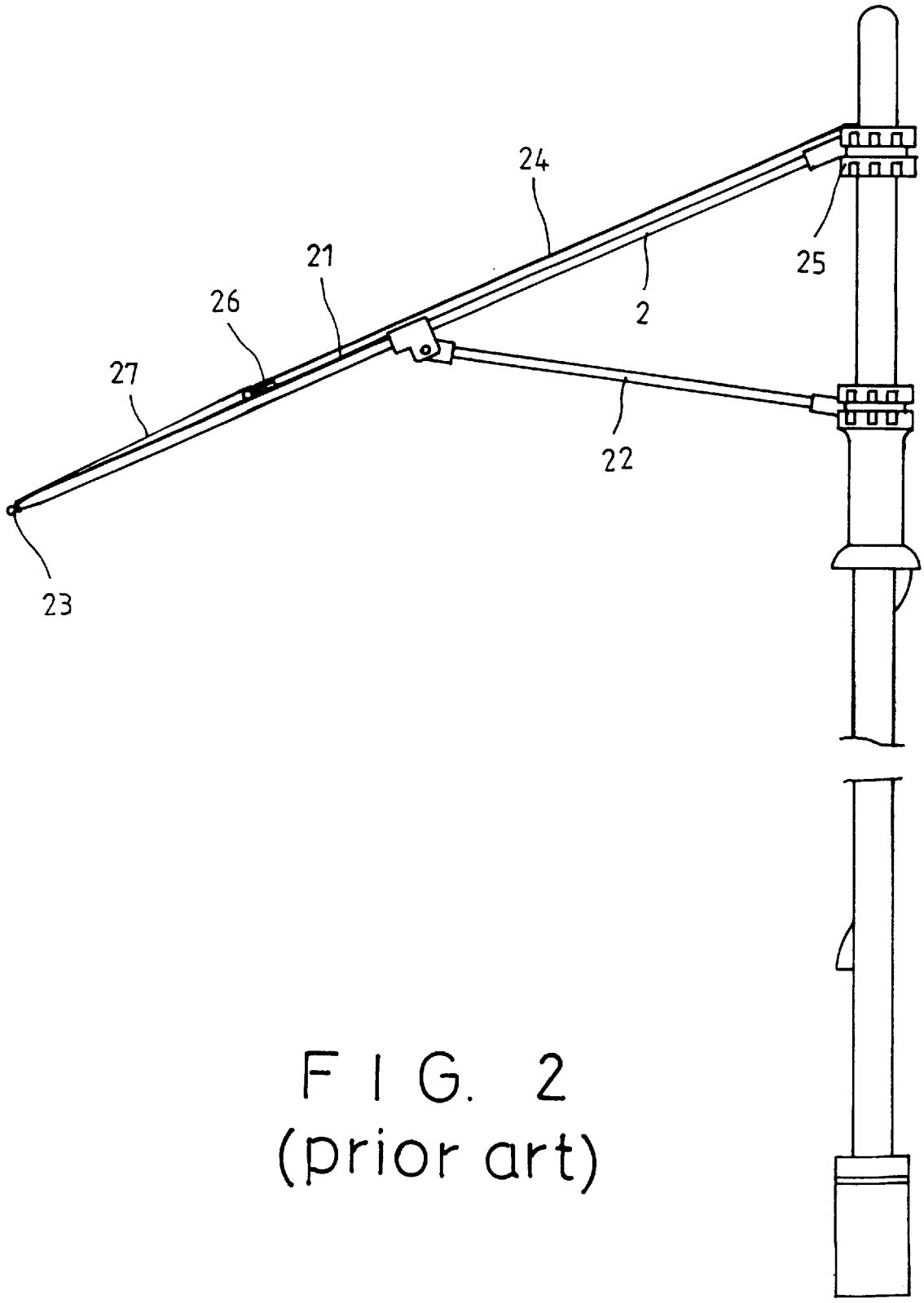
FIG. 2 (prior art)
FIG. 2 is a plan view of another prior known windproof umbrella.
Figures 3, 4:
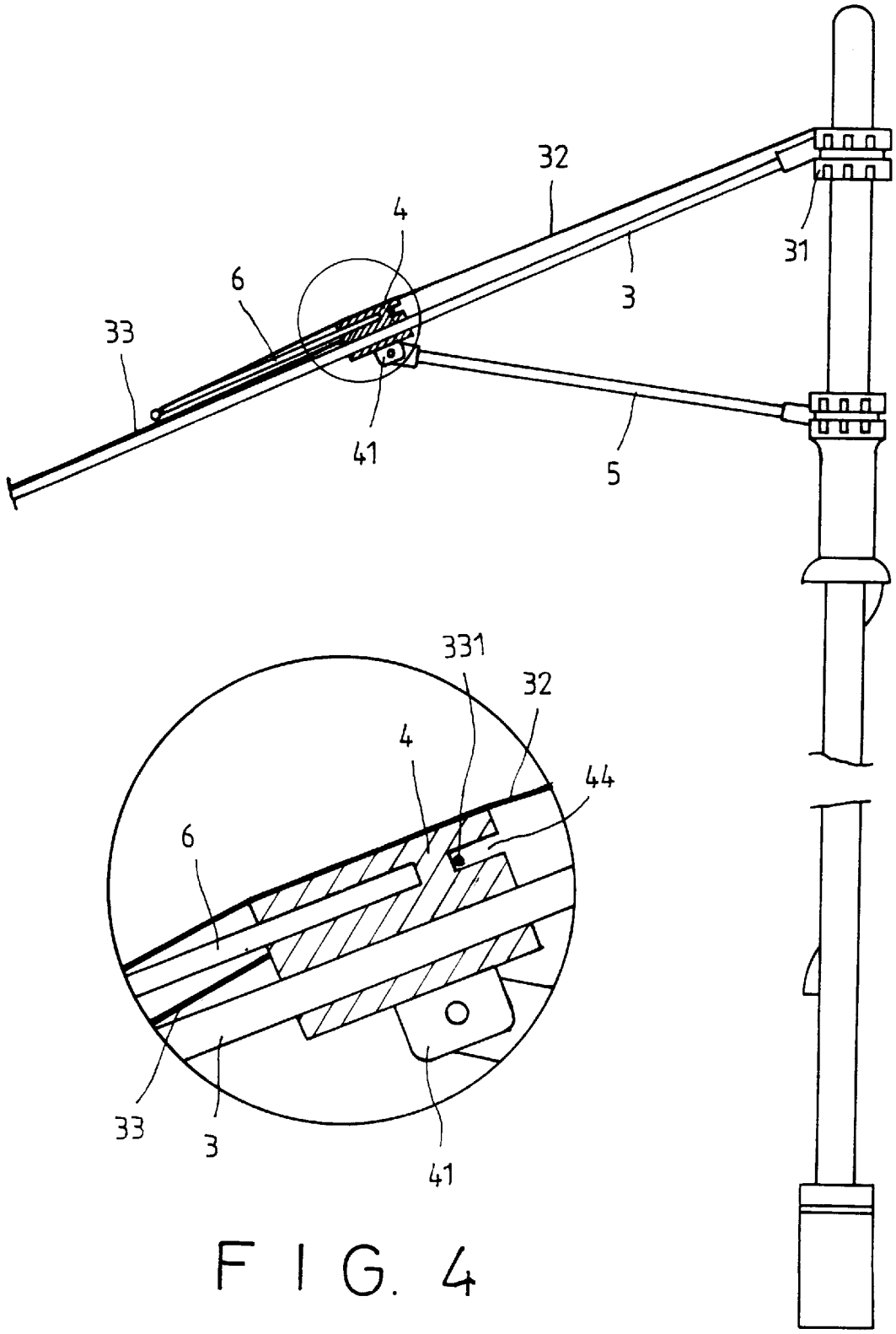
FIG. 3 is a plan view of an improved windproof umbrella according to the present invention.
FIG. 4 is an enlarged view of part of FIG. 3 in accordance with this invention.
Figure 5:
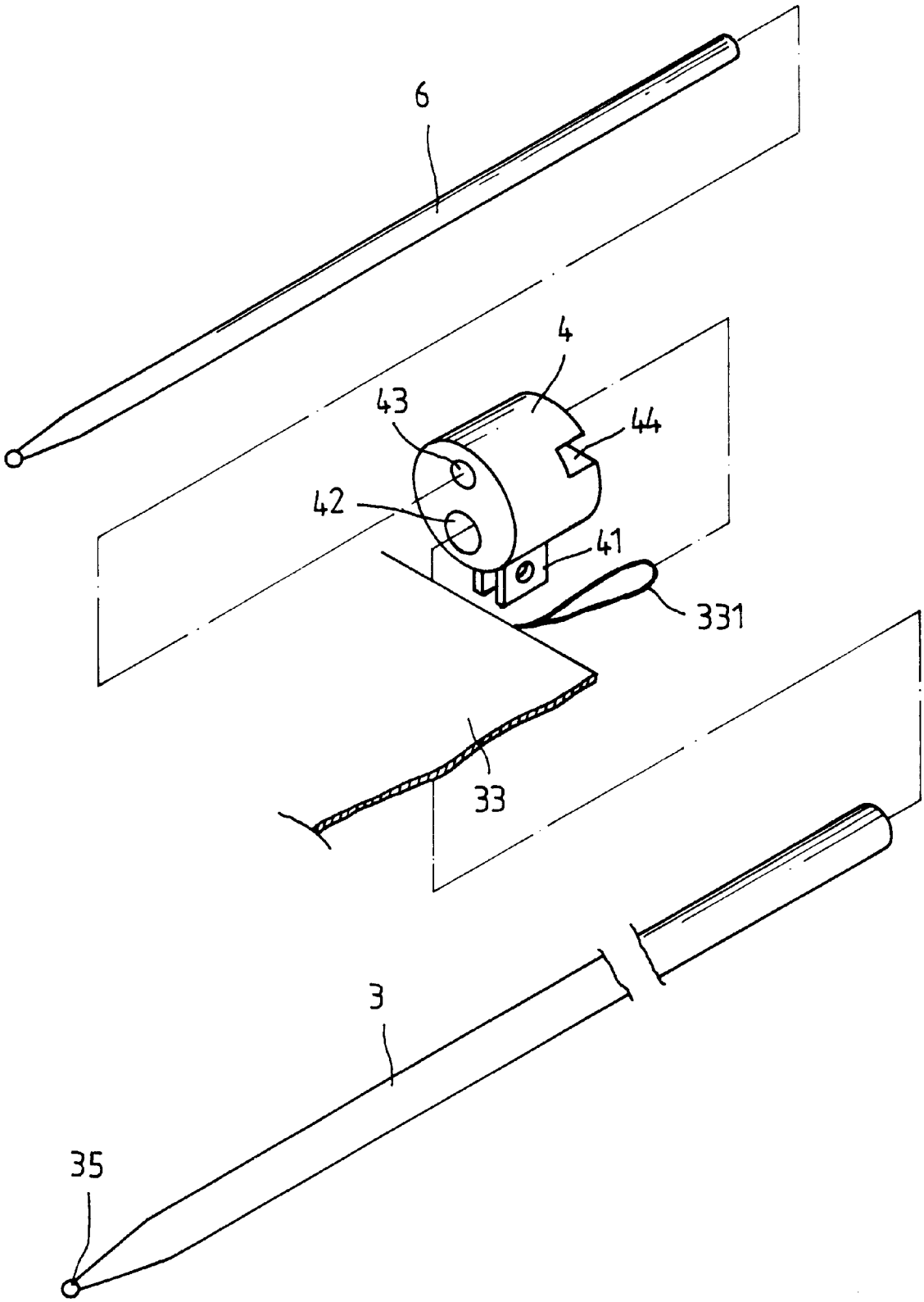
FIG. 5 is an exploded perspective view of part of FIG. 3 in accordance with this invention.

Please refer to FIGS. 3 to 5, the present invention includes a main rib (3) having an inner end pivoted on a notch (31) of the umbrella shaft and connecting with a connector (4) at the middle position. A stretcher (5) has its out end pivoted with a slice (41) of the connector (4). The connector (4) has a central hole (42) for receiving the main rib (3) and has a groove (43) for engaging a second rib (6) therein, and a slot (44) on the other side relating to the groove (43).

The upper cover (32) covers the middle place of the frame and connects the board with the second rib (6), that provides a better connecting strength. The lower cover (33) is provided with several inner rings (331) for hanging at the slot (44) of the connector (4) in convenience. The board of the lower cover (33) can be connected with the ends (35) of the main ribs (3).

Figure 6:
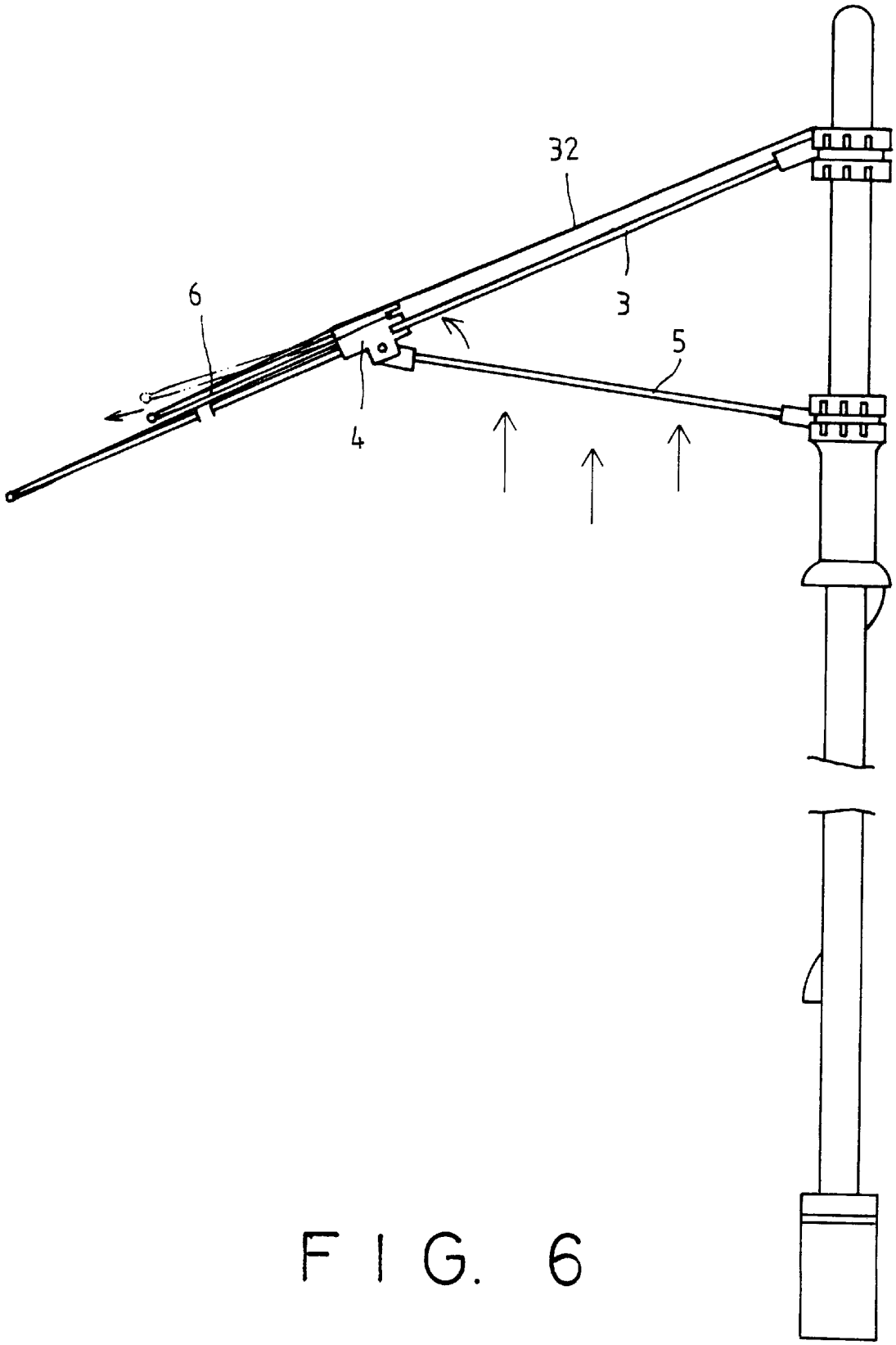
FIG. 6 is a plan view of FIG. 3 during occurring the upward wind in accordance with this invention.
Figure 7:
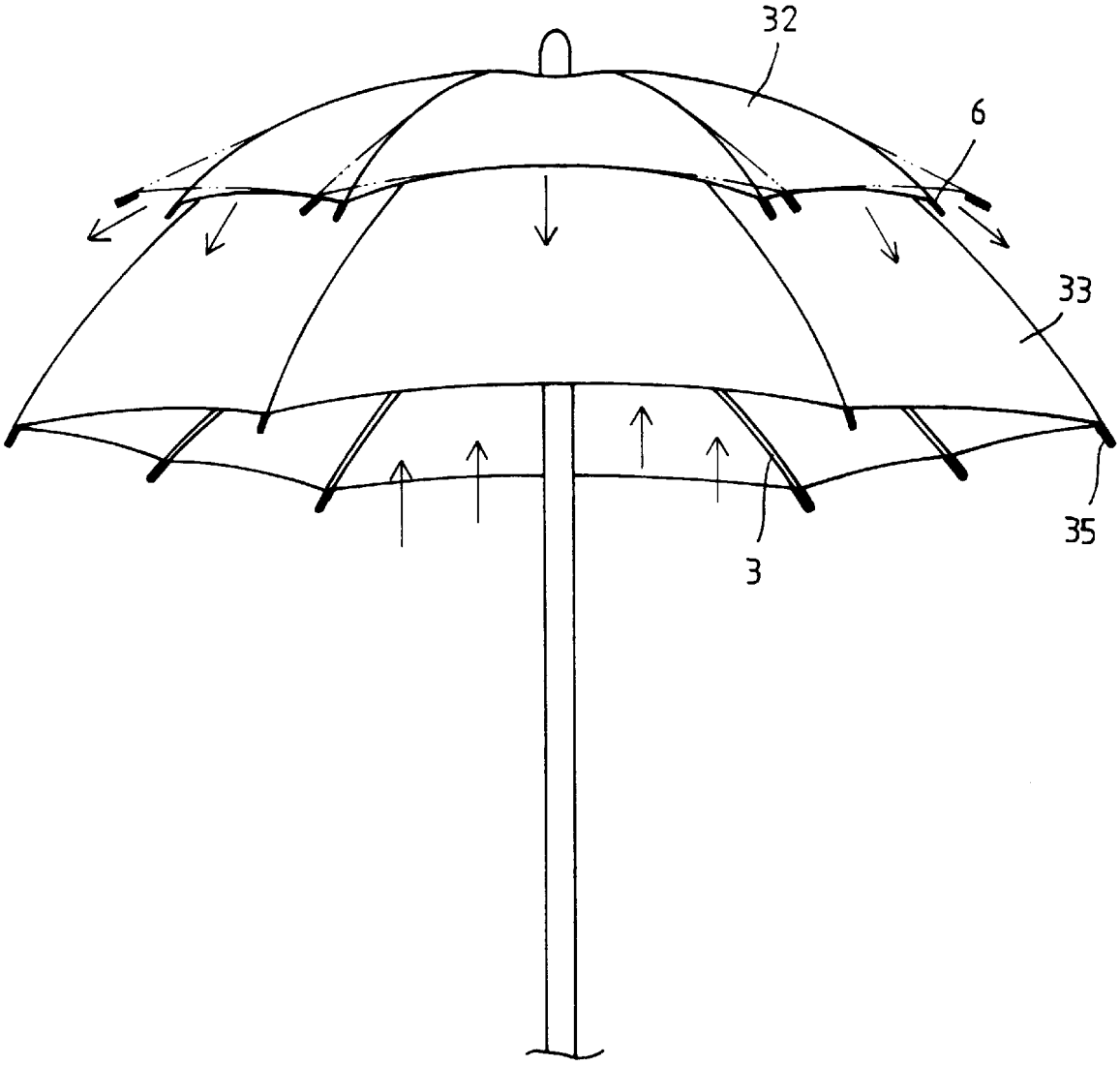
FIG. 7 is a perspective view of FIG. 6 in accordance with this invention.

In use, when the upward wind occurs, the airflow as the arrows in FIGS. 6 and 7, blows to the bottom side of the upper cover (32) that may force the second ribs (6) being moved upward to a position as at an imaging line in the drawings. So the airflow can pass through the gap between the two covers and the wind pressure can be thus released.

Accordingly, it can be found that the present invention obtains an obvious improvement for overcoming the known drawback. Thus, the present invention should be approved and allowed for patent.

I claim:

1. A windproof umbrella structure comprising a frame including a plurality of main ribs each having an inner end pivoted with a notch of an umbrella shaft and connecting to a connector at a middle position; a stretcher having its outer end pivoted with a slice of the connector; the connector being provided with a central hole receiving the main rib and a groove engaging with an inner end of a second rib therein, and a slot at the other side; an upper cover covering the middle position of the frame of the umbrella and having its board connected with the outer ends of the second ribs; a lower cover being provided with several inner rings each directly hanging at the slot of the respective connector and having its board connected with the outer ends of the main ribs.

* * * * *